United States Patent [19]

Imai

[11] 4,033,492

[45] July 5, 1977

[54] LOOPER

[75] Inventor: Isao Imai, Yokohama, Japan

[73] Assignee: Ishikawajima-Harima Jukogyo Kabushiki Kaisha, Ote, Japan

[22] Filed: Apr. 19, 1976

[21] Appl. No.: 678,412

[30] Foreign Application Priority Data

Apr. 30, 1975 Japan ..... 50-52234

[52] U.S. Cl. ..... 226/25; 226/42; 226/44; 72/205; 72/17

[51] Int. Cl.[2] ..... B65H 25/00; B21B 37/06

[58] Field of Search ..... 72/205, 20, 21, 19, 72/6, 17, 18; 226/25, 42, 44, 114

[56] References Cited

UNITED STATES PATENTS

| | | | |
|---|---|---|---|
| 2,345,765 | 4/1944 | Michel | 72/205 |
| 3,237,439 | 3/1966 | Torrance | 72/205 |

*Primary Examiner*—Milton S. Mehr

*Attorney, Agent, or Firm*—Scrivener, Parker, Scrivener & Clarke

[57] ABSTRACT

The invention discloses a looper of the type in which the tension exerted to the strip is controlled in response to the output derived from sensor means attached to a rotatable looper arm for detecting the tension exerted to the strip.

6 Claims, 13 Drawing Figures

Fig.4
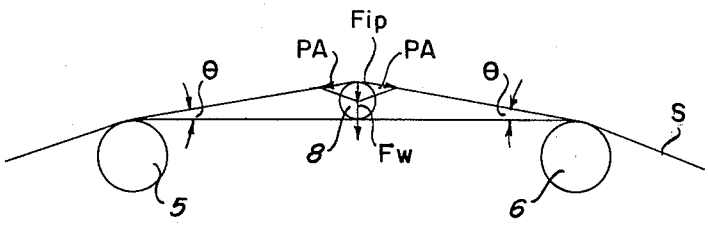
Fig.6
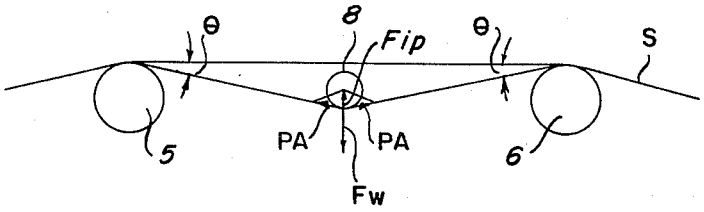
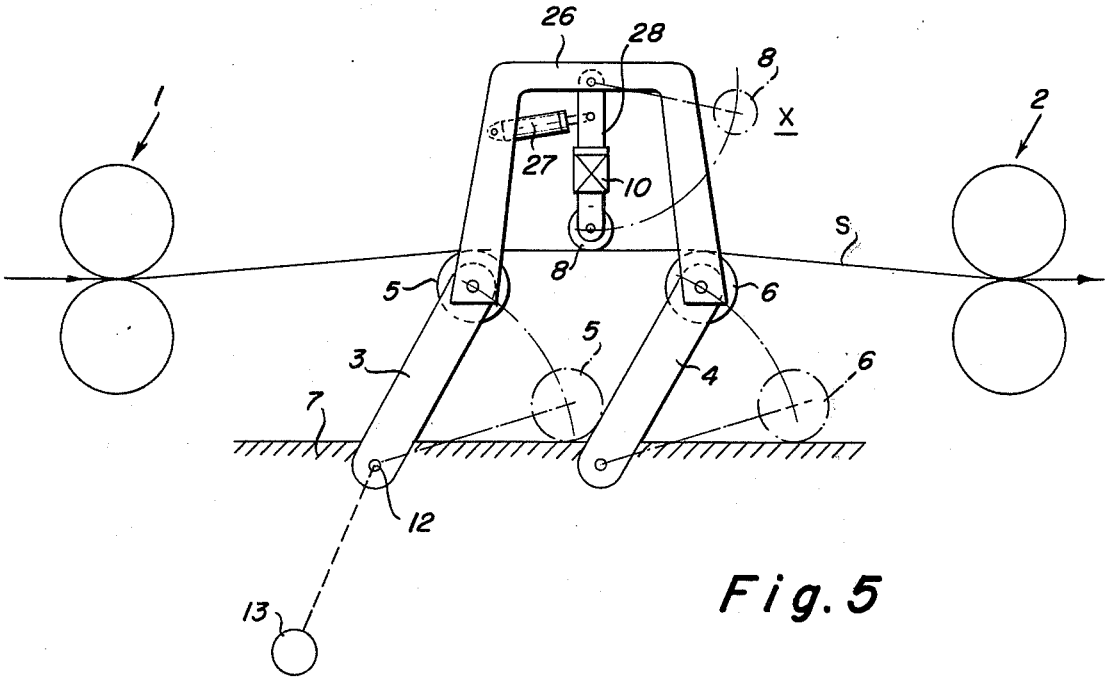
Fig.5

Fig. 10
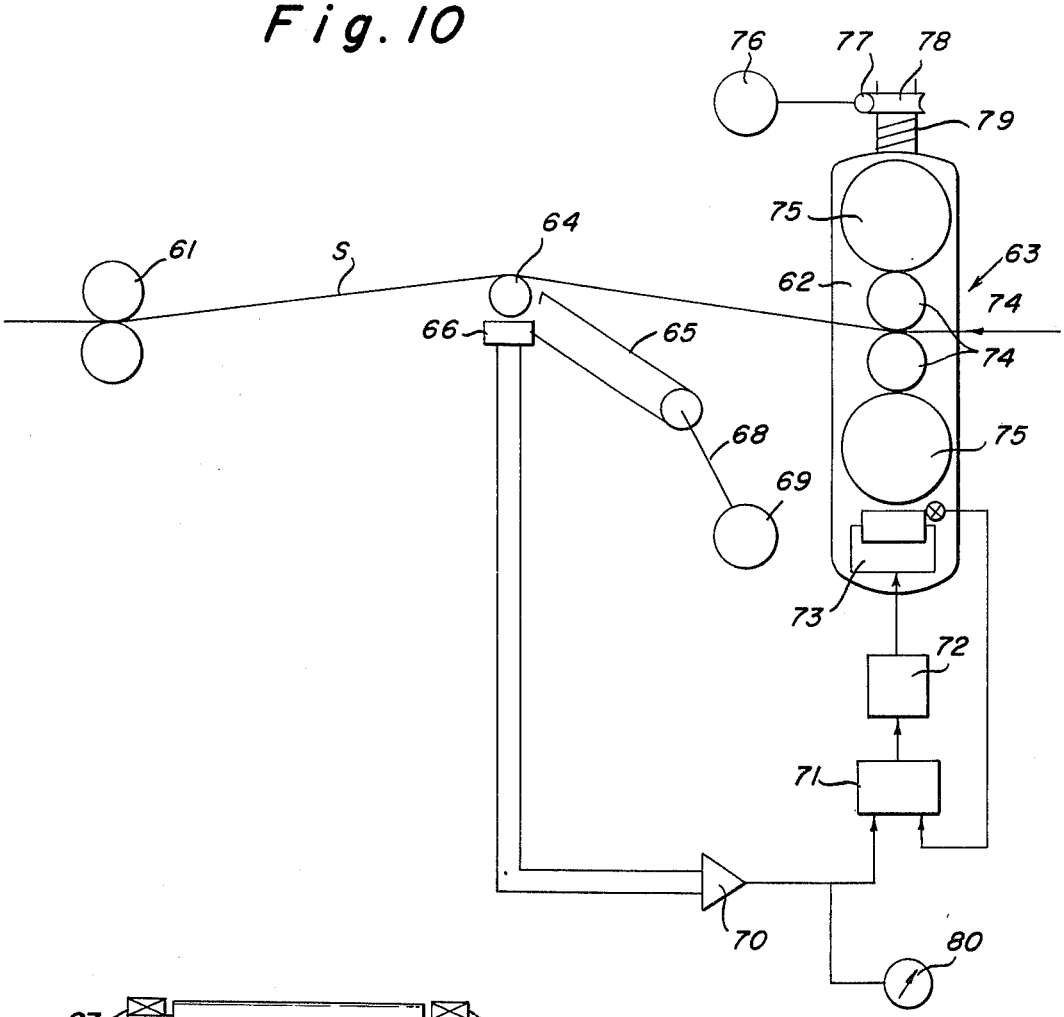
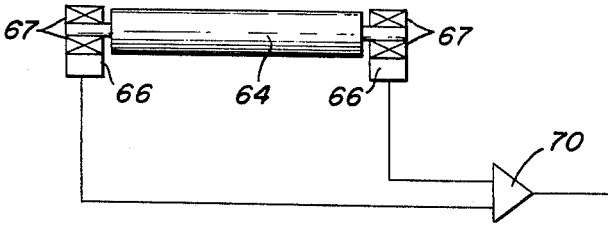
Fig. 11

Fig. 12
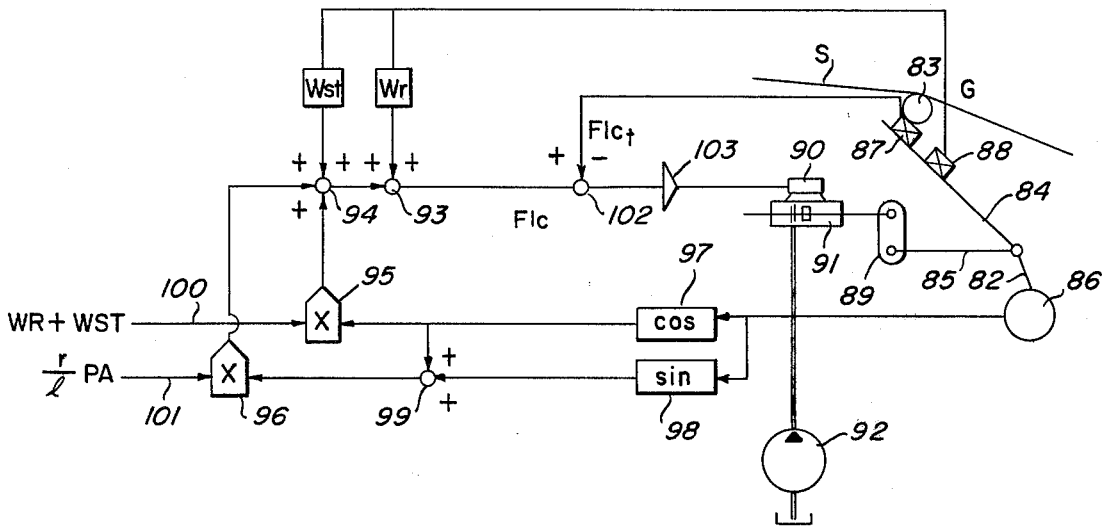
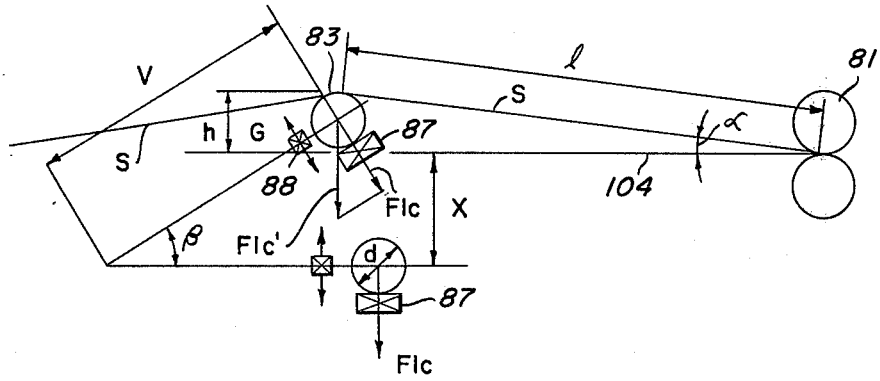
Fig. 13

LOOPER

DETAILED DESCRIPTION OF THE INVENTION

The present invention relates to a looper for use in a hot or cold rolling mill.

It is well known in the art that when the stock is rolled into the strip in a continuous mill, the tension exerted to the strip between the adjacent stands greatly influences the quality of the final products.

For instance, when the tension exerted to the strip between the stands in a continuous hot rolling mill (HSM) changes, both the thickness or gage and width of the strip change. The relation between the change in gage and the change in width is very complex, and the changes in gage and width mutually affect or interfere with each other. Therefore in the recently developed automatic gage control systems, considerable care has been taken so as to avoid the mutual interference between the change in gage and the change in width. With respect to this point, it is well known to those skilled in the art that when the tension exerted to the strip between the stands can be maintained constant and low in response to the output from sensor means for detecting the tension, the mutual interference may be considerably minimized and consequently the control of the gage may be accomplished independently of the change in width. The loopers have been devised based upon the above principle, but the conventional loopers have many problems left to be solved as will be described hereinafter.

The conventional loopers that were initially devised are of the storage looper type which operates in case of an emergency when the mass flow (that is, the cross sectional area of the strip X the rolling speed = constant) between the adjacent stands in a continuous hot rolling mill (HSM) changes. Therefore the looper is normally retracted in the lowered position. As a result, the tension exerted to the strip between the adjacent stands changes, resulting in the change in width. To overcome this problem, the looper has been so improved that it is normally held in the raised position and an automatic system has been devised for controlling the rolling speed in such a way that the looper may be always maintained at a predetermined level. As a result, the tension exerted to the strip between the stands is now maintained constant and low within the meaning of the time scale. When tension is varied by some cause, the force of the tension on the looper is also varied, so that the looper position is changed and as a result, tension change can be sensed by a position sensor. The level or position of the looper can be detected bacause the looper itself is raised or lowered. Therefore when the tension changes due to the change in mass flow which in turn is caused by the change in width, the force exerted to the looper changes, raising or lowering the looper. As a result, the change in tension can be detected from the change in position of the looper.

One of the objects of the present invention is to provide a looper which can detect the tension exerted to the strip between the adjacent stands with a higher degree of accuracy and at a high speed of response.

Another object of the present invention is to provide a looper capable of directly and linearly detecting the tension exterted to the strip between the adjacent stands.

The present invention will become more apparent from the following description of some preferred embodiments thereof taken in conjunction with the accompanying drawings in which:

FIG. 4 is a view used for the explanation therof;

FIG. 5 is a schematic view of a second embodiment of the present invention.

FIG. 6 is a view used for the explanation thereof;

FIG. 10 is a schematic diagram of a fourth embodiment of a looper in accordance with the present invention, the looper being shown as being incorporated in an uneven rolling pressure control unit of a rolling stand;

FIG. 11 is a schematic view of a roller thereof; and

FIGS. 12 and 13 are schematic views of a fifth embodiment.

One of the tension control systems based upon the above underlying principle will be described hereinafter with reference to FIG. 1. The strip S passes from a first or upstream rolling stand *a*to a to a second or downstream stand *b*, and a vertically tiltable looper *c* consisting of a looper arm *d* and a looper roller *e* is so arranged as to hold the looper roller *e* at such a level where the tension exerted to the strip S can be maintained constant.

Figure 1:
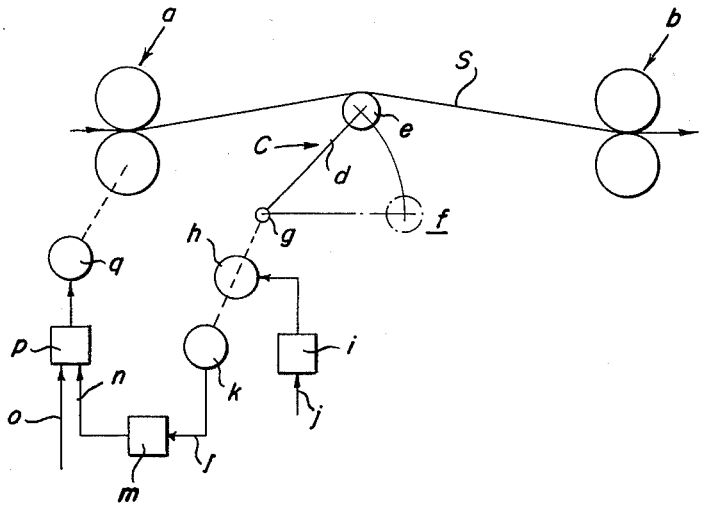
Fig. 1 PRIOR ART
FIG. 1 is a block diagram of a conventional tension control system.

When the strip S passes through the first stand *a*, the looper roller *e* is held in the lowered position *f* indicated by the broken lines in FIG. 1. When the leading edge of the strip S enters into the second stand *b*, the current flows from a control unit *i* into a looper motor *h* in response to a signal *j* so that the looper roller *e* is raised and moved into contact with the strip S. The angular position or looper angle; that is, the angle that the looper arm *d* makes with respect to the horizontal line or pass line of strip S is detected by an angular position sensor *k* directly attached to a hinge *g*, and the output *l* from the sensor *k* is transmitted to an error detector *m* such as a comparator which compares the output *l* with the reference signal. The output or rolling speed correction signal *n* from the error detector *m* is applied to a control unit *p* which in turn controls a motor *q* of the first stand *a*, thereby changing the rolling speed of the strip S. That is, the speed control signal *o* applied to the control unit *p* is increased or decreased in response to the output signal *n* from the error detector *m* so that the looper *c* may be displaced to a predetermined position. When the looper *c* is held in a predetermined position, the tension exerted to the strip S becomes equal to that represented by the signal *j*. The control system is so programmed that the signal *j* may be suitably modified in response to the weight of the strip *s*,the force exerted to the looper *c* and so on.

As described above, in the conventional tension control system shown in FIG. 1, the change in tension is detected only after the change in angular position of the looper *c* has been detected.

Figure 2:
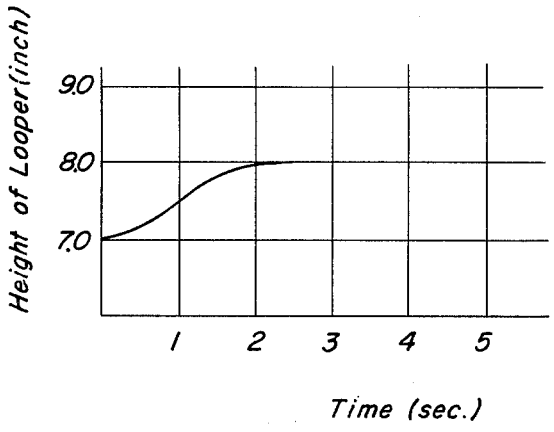
FIG. 2 is a graph used for the explanation thereof.

The conventional tension control system of the type described has, however, various problems to be described hereinafter. In general, the looper has an inertia which is considerably greater than the change in force exerted to the looper due to the change in tension exerted to the strip. (This problem is unavoidable because the rolling stand must be sufficiently rigid to withstand the shocks exerted thereto during the rolling operation). As a result, there exists some time lag between the time when the tension changes and the time when the angular position of the looper changes. In other words, a detection time constant is larger. For instance, the tension detection response time constant (that is, the time constant in case of the detection of the change in angular position of the looper *c* shown in FIG. 1) is about one second as shown in FIG. 2. Therefore, when the change in thickness occurs only less than 1 second, the change in tension cannot be detected. In other words, only the tension frequency change of the order of about 1/16 Hz can be detected.

Furthermore, the relation between the angular position of the looper and the tension is not linear mainly because of the geometrical configuration of the looper (as disclosed, for instance, in "Sheet Metal Industries," March, 1965) so that the change in tension must be detected in response to the looper arm angle compensation signal.

FIRST EMBODIMENT, FIGS. 3 AND 4

Figure 3:
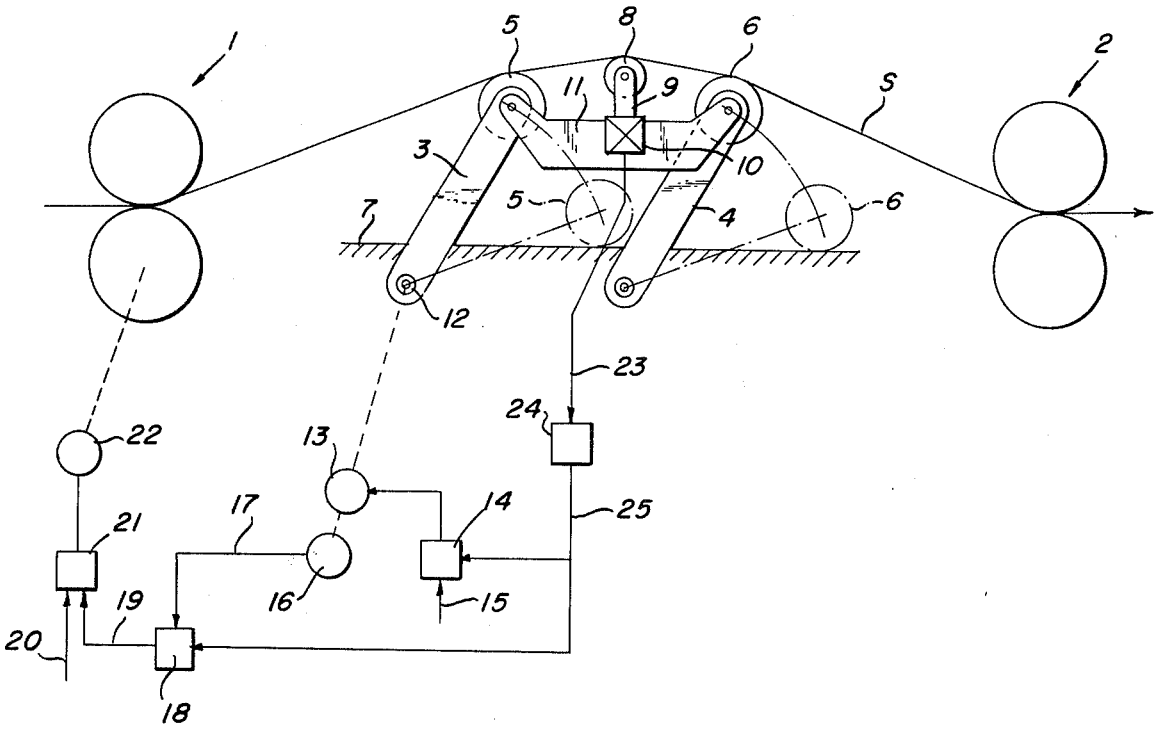
FIG. 3 is a schematic view of a first emobidment of a looper in accordance with the present invention.

Referring to FIG. 3, a looper comprises a first or upstream looper unit consisting of a looper arm 3 and a looper roller 5 and a second or downstream looper unit consisting of a looper arm 4 and a looper roller 6. The first and second looper units, a link 11 interconnecting the looper rollers 5 and 6 and a stationary link or member 7 form a parallel link. A tension detecting roller 8 which contacts the undersurface of a strip S passing between the stands 1 and 2 in the direction indicated by the arrow is rotatably supported by a bracket 9 which in turn is pivoted on the link 11. A sensor 10 such as a load cell for detecting the force exerted on the tension detecting roller 8 is attached to the base of the bracket 9 so that the tension exerted on the strip S between the stands 1 and 2 may be detected through the tension detecting roller 8 regardless of the angle of the looper arms 3 and 4.

A pivot pin 12, with which the looper arm 3 is pivoted to the stationary link or member 7, is dirvingly coupled to a looper motor 13 so that the looper arms 3 and 4 and hence the lopper rollers 5 and 6 may oscillate about the pins 12 of the looper arms 3 and 4.

The output 23 from the load cell 10 is applied to a transducer-amplifier 24 which gives the output 25 to be applied to a control unit 14 for the looper motor 13 and to a control unit 21 for a stand motor 22 of the first stand 1 so that in response to the output 25; that is, the feedback signal, both the motors 13 and 22 are driven and consequently the tension exerted to the strip S between the first and second stands 1 and 2 is controlled. Reference numeral 16 denotes an angular position detector; 17, a signal; 18, an error detector; 19, a rolling speed correcting signal; 20, a rolling speed signal; and 25, the tension signal.

As with the conventional control system described above with reference to FIG. 1, the tension may be controlled in response to the output signal from the angular position detector 16, but as described above the speed of response is slow. Therefore in the first embodiment shown in FIG. 3, the tension is directly detected by tension detecting means attached on the link 11. That is, the force acting upon the tension detecting roller 8 is converted by the load cell 10 into the output signal representative of the tension exerted to the strip S. The output signal 23 from the load cell 10 is converted by the transducer-amplifier 24 into the tension signal 25 which is applied not only to the control unit 14 of the looper motor 13 but also to the error detector 18. In the control unit 14, the tension signal 25 is compared with a tension setting signal 15, and in response to the output control signal from the control unit 14 the motor 13 is driven in such a way that the looper rollers 5 and 6 may be displaced to suitable angular positons were the tension exerted to the strip S can be maintained constant.

In response to the tension signal 25, the error detector 18 immediately detects the change in tension before the angular position of the looper arms 3 and 4 is changed, and in response to the rolling speed correction signal 19 from the error detector 18 the control unit 21 changes the rotational speed of the motor 22 of the first stand 1. Therefore the looper arms 3 and 4 with greater inertia can be maintained substantially at the same angular positions. Since the tension is controlled at a high speed by the motor 22 of the first stand 1, the tension control system can minimize the change in tension exerted to the strip S.

Next referring to FIG. 4, the relation between the tension and the output signal from the tension detector means will be described. Let $F_p$ denote the force acting on the tension detecting roller 8 due to the tension PA exerted to the strip S between the stands 1 and 2, where PA= unit tension P × cross sectional area A in the direction of width of the strip S, and let $\theta$ denote the angle between the strip S and the horizontal line connecting between the tops of the first and second looper rollers 5 and 6. Then, the following relation is obtained:

$$F_p = 2PA \sin \theta$$

The force $F_w$ acting on the tension detecting roller 8 due to the weight of the strip S is $$F_w = \text{width} \times \text{gage} \times \text{specific gravity of strip } S \times \text{length of strip } S \text{ between the rollers 5 and 6.} \quad (2)$$

The force $F_W$ is, therefore, constant, and the overall force (detection force) acting on the tension detecting roller 8 is $$\begin{aligned} F &= F_p + F_W \\ &= 2PA \sin \theta + F_W \end{aligned} \quad (3)$$

In Eq. (3) only the tension PA changes so that tension may be directly and linearly detected.

SECOND EMBODIMENT, FIGS. 5 AND 6

The second embodiment shown in FIG. 5 is different from the first embodiment shown in FIG. 3 in that the tension detecting roller 8 contacts the upper side of the strip S whereas in the first embodiment it contacts the under side. The tension signal 25 similar to that of the first embodiment may be derived. In the second embodiment, there must be provided an arrangement so that the strip S may easily pass between the looper rollers 5 and 6 and the tension detecting roller 8. For this purpose, a bracket 28, upon which are mounted the tension detecting roller 8 and the load cell 10, is pivotably attached to and suspended from a link 26. The piston rod of a power cylinder 27 pivoted to the link 26 is connected to the bracket 28 so that when the cylinder 27 is actuated the bracket 28 with the tension detecting roller 8 and the load cell 10 may rotate about its pivot pin. Therefore when the strip S is extended from the first stand 1 to the second stand 2, the bracket 28 is retracted away from the passage of the strip S to the raised position indicated by the broken lines. After the strip S enters into the second stand 2, the cylinder 27 is actuated to return the bracket into the operative position indicated by the solid lines so that the tension detecting roller 8 contacts the upper side of the strip S passing from the first stand 1 to the second stand.

Next the relation between the tension exerted to the strip and the detection signal will be described with reference to FIG. 6. In the second embodiment, the direction of the force $F_W$ is opposite to the force $F_W$ in the frist embodiment. Therefore, $$F = 2PA \sin \theta - F_W \quad (3')$$

In Eq. (3') only PA changes as in Eq. (3) so that the tension can be directly and linearly detected.

Figure 7:
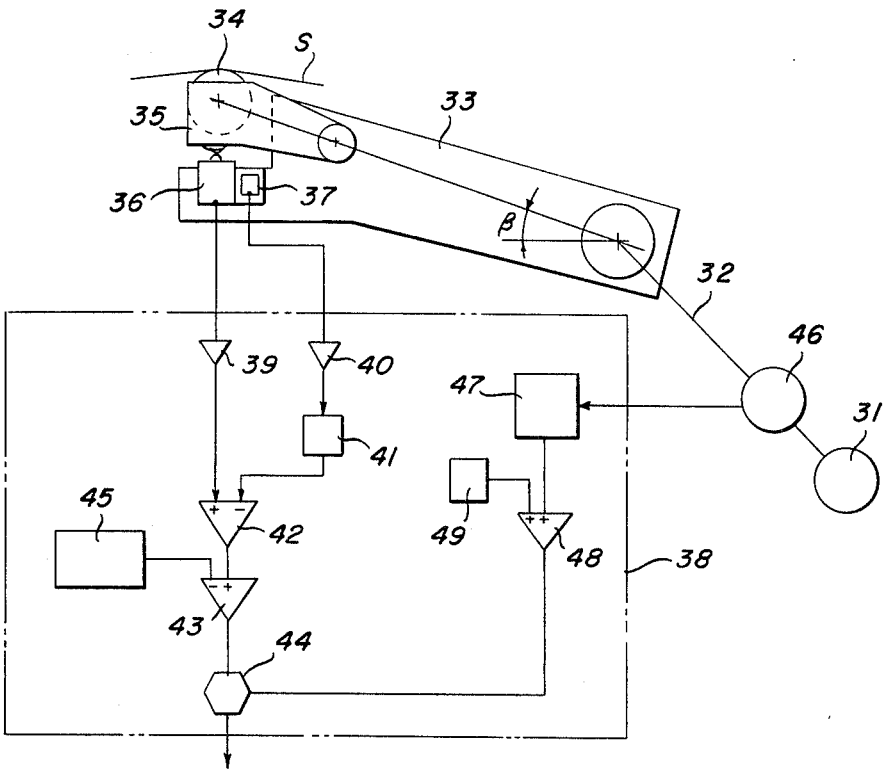
FIG. 7 is a schematic diagram of a third emobidment in accordance with the present invention.
Figure 8:
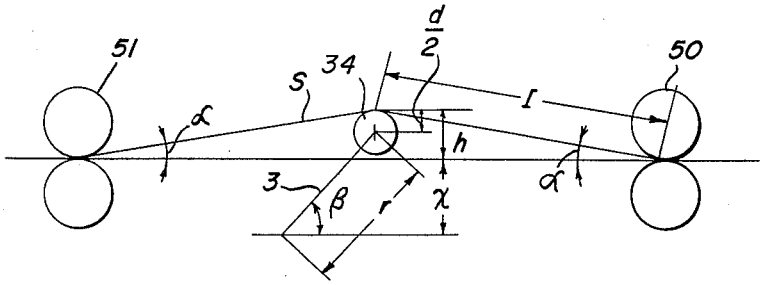
FIG. 8 is a view used for the explanation thereof.
Figure 9:
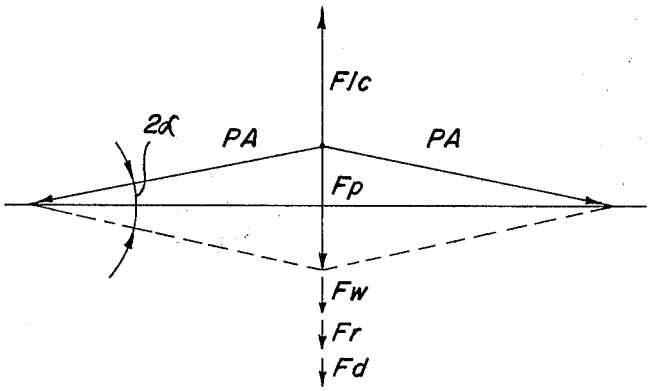
FIG. 9 is a vector diagram used for the explanation of the third embodiment shown in FIG. 7.

THRID EMBODIMENT, FIGS. 7, 8 and 9

In both the first and second embodiments described above, the dynamic load produced by the acceleration of the looper rollers is also detected, but according to the third embodiment, such transient dynamic load is not detected so that the tension control with a higher degree of accuracy may be attained.

First referring to FIG. 7, one end of a looper arm 33 is pivoted to one end of a driving shaft 32 whose other end is attached to a looper motor 31. A roller bearing box 35 in which is rotatably supported a looper roller 34 is pivoted to the other end of the looper arm 33. A sensor 36 such as a load cell which supports the undersurface of the roller bearing box 35 and an accelerometer 37 are mounted on the looper arm 33 adjacent to the other end thereof.

The sensor 36 and the accelerometer 37 are connected to amplifiers 39 and 40, respectively, of an analog arithmetic unit 38. The amplifier 39 is directly connected to an addition amplifier 42 while the amplifier 40 is connected thereto through a weight conpensation potentiometer 41. The output of the amplifier 42 is connected through an addition amplifier 43 to a divider 44. The output from a setting unit 45 is also applied to the input of the second addition amplifier 43.

An angular position detector 46 attached to the driving shaft 32 is connected to a sine function generator 47 which in turn is connected through a third addition amplifier 48 to the divider 44. The output from a second setting unit 49 is also applied to the input of the third addition amplifier 48.

In FIG. 8, reference numeral 50 denotes a first or upstream stand; 51, a second or downstream stand; and S, a strip.

Next the underlying principle of the third embodiment will be described with particular reference to FIGS. 8 and 9. Let $F_p$ denote the force acting vertically on the looper roller 34 due to the tension PA of the strip S which makes an angle with the horizontal line connecting between the roll bites of the first and second stands 50 and 51; let $F_W$ denote the force vertically acting on the looper roller 34 due to the weight of the strip S; let $F_R$ denote the force acting vertically due to the weight of the looper roller 34; let $F_D$ denote the vertical force due to the acceleration caused by the vertical movement of the looper roller 34; and let $F_{LC}$ denote the sum of these forces acting on the sensor.

Then, as is readily seen from FIG. 9, the following relation is held:

$$F_{LC} = F_p + F_W + F_R + F_D \quad (4)$$

The force $F_P$ is given by $$F_p = 2PA\ h/l \text{ Tm} \quad (5)$$

where $h$ = distance between the top of the looper roller 34 and the pass line of strip; and $l$ = length of strip between the nip of the first or second stand 50 or 51 and the top of the looper roller 34.

Let $r$ denote the distance between the axis of rotation of the looper arm 33 and the axis of rotation of the looper roller 34; let $d$ denote the diameter of the looper roller 34; let $x$ denote the length of the perpendicular from the axis of rotation of the looper arm 33 to the pass line of strip; and let $\beta$ denote the angle between the pass line of strip and the line connecting between the axis of rotation of the looper arm 33 and the center of rotation of the looper roller 34.

Then the height $h$ is $$h = r \sin \beta + d/2 - x = r \sin \beta + Y \quad (6)$$

where $y = d/2 - x$

Since $F_W$ is a function of width and gage of the strip S, $$F_W = 2\ A\ \gamma\ l \quad (7)$$

where $A$ = cross sectional area, and $\gamma$ = specific gravity of strip S.

The weight $W_R$ of the looper roller 34 equals $F_R$; that is, $$F_R = W_R \quad (8)$$

The vertical dynamic load $F_D$ is given by $$F_D = W_R\ G \quad (9)$$

where $G$ = acceleration.

Substituting Eq. (5), (6), (7), (8) and (9) into Eq. (4), we have $$F_{LC} = \frac{2PA}{l}(r \sin \beta + y) + 2A\gamma l + W_R + W_{R\ G} \quad (10)$$

Solving Eq. (10) for tension PA, we have $$PA = (F_{LC} - 2A\gamma l - W_R - W_R \cdot G)\frac{l}{2(\gamma \sin \beta + y)} \quad (11)$$

In the third embodiment, the tension PA is obtained from the analog arithmetic unit 38 which executes Eq. (11).

Next the mode of operation of the third embodiment will be described. First both the weight 2A $\gamma$ $l$ of the strip S between the first and second stands 50 and 51 and the weight $W_R$ of the looper roller 34 are set into the first setting unit 45 while $y = (d/2 - x)$ is set into the second setting unit 49. When the strip S is passing from the first stand to the second stand, the looper motor 31 is driven to rotate the looper arm 33 through a suitable angle $\beta$ so that the strip S makes the angle $\alpha$ with respect to its pass line. The overall force $F_{LC}$ acting on the sensor 36 is the sum of the vertical force $F_p$ due to the tension PA exerted to the strip S, the vertical force $F_W$ due to the weight of the strip S, the vertical force $F_R$ due to the weight of the looper roller 34 and the vertical force $F_D$ due to the acceleration in the vertical movement of the looper roller 34. The output from the sensor 36 is amplified by the first amplifier 39 and applied to the first addition amplifier 42 while the force $F_D$ detected by the accelerometer 37 is applied through the second amplifier 40 to the weight correction potentiometer 41 where the output signal is converted into the signal representative of the force $W_{RG}$. The output from the potentiometer 41 is applied to the first addition amplifier 42. Therefore, the output from the first addition amplifier represents $F_{LC} - W_{RG}$. The output from the first addition amplifier 42 is applied to the second addition amplifier 43 to which is also applied the output of the first setting unit 45 representing $2A\gamma l + W_R$. Therefore the output from the second addition amplifier 43 represents $l\{(F_{LC} - W_{RG}) - 2A\gamma l - W_R\}$ and is applied to the divider 44.

The angle $\beta$ of the looper arm is detected by the angular position detector 46, and the output therefrom is applied to the sine function generator 47. The output from the sine function generator 47; that is, $r$ sine $\beta$, is applied to the third addition amplifier 48 to which is also applied the output $y$ from the second setting unit 49. Therefore the output from the third addition amplifier 48 represents $2(r \sin \beta + y)$ and is applied to the divider 44, where the execution of Eq. (11) is carried out. Therefore the output from the divider 44 represents the tension PA, in response to which the angular position of the looper arm 33 is controlled.

FOURTH EMBODIMENT, FIGS. 10 AND 11

The fourth embodiment in accordance with the present invention is applied to an uneven rolling pressure detection control system for a rolling mill.

Referring to FIGS. 10 and 11, a looper including a looper roller 64 is interposed between a stand 61 and a stand 62 of a rolling mill 63. The looper roller 64 is supported by looper roller bearings 67 which in turn are mounted on sensors 66 attached to one or upper end of a looper arm 65. The other end (that is, the lower end in FIG. 10) of the looper arm 65 is connected to a shaft 68 of a looper motor 69.

The sensors 66 are connected to an operational amplifier 70 for obtaining the difference between the loads detected by the sensors 66, and the output from the operational amplifier is applied to a hydraulic reduction control unit 71 of the rolling mill 63.

The rolling pressure control systems are in general divided into two types. One type is hydraulic and consists of the control unit 71, a valve 72 and a hydraulic cylinder 73 so that as the piston rod of the hydraulic cylinder 73 is extended or retracted a work roll 74 and a backup roll 75 may be vertically displaced. The other type is called the control with reduction screw, and consists of a motor 76 drivingly coupled to a worm 77 in mesh with a worm wheel 78 and a reduction screw 79 attached to the worm wheel 78. As the motor 76 is driven, the reduction screw 79 is rotated whereby the work roll 74 and the backup roll 75 may be vertically displaced. However, the hydraulic rolling pressure or reduction control system is more widely used recently than the control with reduction screw.

The output from the operational amplifier 70 is also applied to a meter 80 for indicating the difference between the loads detected by the sensors 66.

Next the mode of operation of the fourth embodiment with the above construction will be described hereinafter. First the looper motor 69 is energized so that the looper arm 65 is rotated about its axis of rotation in the clockwise direction, and consequently the looper roller 64 is pressed against the underside of the strip S under a predetermined pressure. The pressure with which the lopper roller 64 is pressed against the strip S is produced by the looper motor 69 in such a way that the pressure is in equilibrium with the vertical component of the resultant force of the tension exterted to the strip S between the stands 61 and 62.

The strip S which is rolled by the work rolls 74 passes over the looper roller 64 and enters the stand 61. The resultant force of the tension exerted to the strip S acts vertically upon the roller 64 and is detected by the sensors 66. When the strip S is rolled under the uneven rolling pressure, the thickness of the strip S changes so that the vertically acting resultant forces detected by the sensors 66 are different from each other. In response to the outputs from the sensors 66, the operational amplifier 70 derives the difference between the loads detected by the sensors 66, and the output from the operational amplifier 70 is applied to the control unit 71 so that the lower hydraulic cylinder 72 and an upper hydraulic cylinder (not shown) are actuated and consequently the uneven rolling pressure exerted by the work rolls 74 to the strip S is automatically adjusted to become even or uniform.

FIFTH EMBODIMENT, FIGS. 12 AND 13

In the fifth embodiment shown in FIGS. 12 and 13 the tension exerted to the strip S is detected and fed back to driving means for a looper arm.

Referring first to FIG. 12, a looper arm 84 with a looper roller 83 and a pivotable arm 85 are drivingly coupled to a rotary shaft 82 to which is attached an angular position detector 86. A detector such as a load cell 87 as well as an accelerometer 88 are mounted on the looper arm 84. The pivotable arm 85 is operatively coupled through a link 89 to a piston rod of a hydraulic cylinder 91 with a servo valve 90 to which is transmitted the hydraulic pressure from a hydraulic pump 92.

The output from the accelerometer 88 is applied through a first setting unit for setting the weight $W_R$ of the looper roller 83 to a first operational amplifier 93 and through a second setting unit for setting the weight of the strip S to a second operational amplifier 94. The outputs from first and second multiplier 95 and 96 are also applied to the second operational amplifier 94 the output of which is applied to the input of the first operational amplifier.

The output from the angular position detector 86 is applied to a cosine function generator 97 and a sine function generator 98, and the output from the cosine function generator 97 is applied to the first multiplier 95 and to a third operational amplifier 99. The output from the sine function generator 98 is applied to the third operational amplifier 99 and the output from the third operational amplifier is applied to the second multiplier 96. The signal 100 representative $W_R + Wst$ is applied to the first multiplier 95 while the signal 101 representative of $r/l$ PA or PA$r/l$ (that is, a tension to be set) is applied to the second multiplier 96.

The output from the load cell 87 is applied to a fourth operational amplifier 102 to which is also applied the output $F_{LC}$ from the first operational amplifier 93. The output derived from the fourth operational amplifier is applied to a servo amplifier 103 whose output is applied to the servo valve 90.

Next the underlying principle of the fifth embodiment will be described with particular reference to FIG. 13. The following force acts on the load cell 87:

$$F_{LC} = (F_P + F_W + F_R + F_{SD}) \cos \beta + F_{RD} \quad (12)$$

where $$F_P = 2PA\ h/l \quad (13)$$
$$F_W = 2A\ l\ \gamma \quad (14)$$
$$F_R = W_R \quad (15)$$
$$F_{SD} = 2/3\ (Wst)\ (G/\cos \beta \quad (16)$$
$$F_{RD} = W_R G \quad (17)$$

$F_{LC} = F'_{LC} \cos \beta$; that is, a load to be set to the load cell (see FIG. 13), $F_P$ = vertical force due to tension exerted to the strip S, $F_W$ : vertical force due to weight of strip S, $F_R$ : weight of looper roller, $F_{SD}$ : dynamic load of strip S, $F_{RD}$ : dynamic load due to the mass of looper roller, $P$ : unit tension, $A$ : cross sectional area of the strip S in its transverse direction, $h$ : length of the perpendicular from the top of the looper roller to the pass line 104 of the strip S, $l$ : length of the strip S between the roll bites of the stand 81 and the top of the looper roller 83,

$\gamma$ : specific gravity of strip S, $G$ : vertical component of acceleration exerted to the looper arm 84,

$\beta$ : angle between the looper arm 84 and the pass line 104 of the strip.

From FIG. 13,

$$h = r \sin \beta + d/2 - x = r \sin \beta + y \quad (A)$$

where $y = d/2 - x$ substituting Eq. (A) into Eq. (13), we have $$F_P = 2PA\ (r' \sin \beta + y)/l \quad (13')$$

Substituting Eqs. (13'), (14), (15), (16) and (17) into Eq. (12), we have $$F_{LC} = r/l\ (\sin 2\beta + 2y/r \cos \beta)\ PA + (W_R + Wst) \cos \beta + W_{RG} + 2/3 WstG \quad (18)$$

where $r$: length of looper arm 84,

$d$: diameter of looper roller 83,

$x$: length of the perpendicular from the axis of rotation of the looper arm 84 to the pass line 104, and $G$: the vertical component of acceleration exerted to the looper arm 84.

Therefore a closed control loop for controlling the tension constant may be established in which the difference between the output signal $F_{LCF}$ detected by the load cell 87 and the load $F_{LC}$ which is calculated from Eq. (18) based upon the tension $r/l$ PA to be set and which acts on the load cell 87 when the strip S is under the desired tension can be made zero. That is, the following relation must be established:

$$F_{LC} - F_{LCF} = 0 \quad (19)$$

Next the mode of operation will be described. The change in angle $\beta$ which is caused by the change in the tension exerted to the strip S is detected by the angular position detector 86, and the output from the detector 86 is applied to both the cosine- and sine-function generators 97 and 98. The output cos $\beta$ from the cosine function generator 97 is applied to the first multiplier 95 and the third operational amplifier 99 while the output sine 2 $\beta$ from the sine function generator 98 is applied to the third operational amplifier 99. Therefore the output derived from the third operational amplifier represents (sin 2 $\beta$ + 2y/r cos $\beta$).

In the first multiplier 95 the output cos $\beta$ from the cosine function generator 97 is multiplied by the setting signal 100 representative of ($W_R$ + W$st$) so that the output from the first multiplier 95 represents ($W_R$ + W$st$) cos $\beta$ and is applied to the second operational amplifier 94. In the second multiplier the output from the third operational amplifier 99 representative of (sin 2 $\beta$ + 2y/r cos $\beta$) is multiplied by the tension setting signal 101 representative of $r/l$ PA so that the output from the second multiplier represents the first term $r/l$ (sin 2 $\beta$ + 2y/r cos $\beta$) PA of Eq. (18) and is applied to the second operational amplifier.

In addition to the inputs representative of $r/l$ (sin 2 $\beta$+ 2y/r cos $\beta$) PA and ($W_R$ + W$st$) cos $\beta$ described above, applied to the second operational amplifier 94 is the input representative cf the fourth term of Eq. (18); that is, 2/3 W$st$ G which is the product of the vertical component G of the acceleration exerted to the looper arm 84 and detected by the accelerometer 88 and the weight Wst of the strip S. The output from the second operational amplifier 94 is applied to the first operational amplifier 93 to which is also applied the input representative of G $W_R$; that is, the third term of Eq. (18) and the product of the vertical component G of the acceleration exerted to the looper arm 84 and the weight $W_R$ of the roller 83. The output of the first operational amplifier 93 representing $F_{LC}$ is applied to the operational amplifier 102 to which is also applied the output $F_{LCF}$ from the load cell 87. The output from the third operational amplifier 102 represents the difference between $F_{LCF}$ and $F_{LC}$, and is applied to the servo amplifier 103. In response to the output from the output from the servo amplifier 103, the servo valve 90 is actuated, and consequently depending upon the flow rate of the hydraulic liquid supplied from the hydraulic pump 92 and controlled by the servo valve 90, the stroke of the piston rod of the hydraulic actuator 91 changes. The displacement of the piston rod of the actuator 91 is transmitted through the link 89 and the pivotable arm 85 to the rotary shaft 82 so that the looper arm 84 is rotated in the direction in which the tension exerted to the strip S may be constant.

It is to be understood that the present invention is not limited to the preferred embodiments described above and that various modifications can be effected without departing the true spirit of the present invention. For instance, in the first and second embodiments the number of looper rollers may be arbitarily selected. In the second embodiment, instead of the controlling the rotational speed of the motor 22 of the first stand 1 through the control unit 21 in response to the tension detected through the tension detecting roller 8 in such a way that the tension may be maintained constant, a control unit for controlling the roll gap of the first stand may be so actuated as to control the roll gap, thereby maintaining the tension constant. In the third embodiment, instead of the analog arithmetic unit, a digital arithmetic unit may be employed. In addition, any suitable compensation methods may be employed in the arithmetic operations. In the fourth embodiment, instead of using the output signal from the sensors of the looper as the signalfed back to the hydraulic rolling pressure control system, it may be used as the signal fed back to the control system with reduction screw. In the first, second, third and fifth embodiments, instead of the hydraulic cylinders, pneumatic cylinders and motors or hydraulic or electric motors may be used. Because of the construction of the looper in accordance with the present invention, not only load cells but also suitable spring type sensors for detecting the displacement and pressure gages may be used as sensor means for converting the force acting upon the looper roller into the electrical signal.

The advantages and features of the loopers in accordance with the present invention may be summarized as follows:

1. The tension exerted to the strip between the stands can be directly and linearly detected regardless of the height or level of the looper roller and the angular position of the looper arm. Especially in the first and second embodiments, the geometrical relation of the tension detecting roller remains unchanged regardless of the position of the looper (because the looper rollers 5 and 6 are geometrically isolated) so that the tension may be detected always under the same conditions.

2. The speed of response of the looper arm itself is rather slow, but the inertia of the tension detecting roller and the tension detecting sensor which detect the tension can be made considerably small. In addition, if the load cell is used as a sensor for detecting the tension, the phsical displacement may be negligible. As a result, the rigidity can be increased and the high natural frequency may be selected so that the high speed of response may be obtained. (The detection speed is more than 100 times as fast as that of the conventional systems.)

3. The change in tension can be detected before the change in angular position of the looper arm. Therefore in response to this signal the driving motor of the first or upstream stand may be controlled or the roll gap of the first or upstream stand may be controlled so that the tension may be controlled directly (that is, without changing the angular position of the looper).

4. In the first and second embodiments, the tension can be detected regardless of the angular position of the looper arm so that the signal representative of the detected tension may be fedback in such a way that the looper itself can be controlled to maintain the constant tension.

5. In the fourth embodiment, the sensor or load cell is not required to be attached to the rolling mill. Therefore a load cell or the like with a small full scale or scale range may be used, and consequently very sensitive detection of uneven rolling pressure becomes possible.

6. In the fourth embodiment, the meter is provided for the operators in order to indicated the difference between the loads detected by two sensors. Therefore, in case of an accident or abnormal operation, the operators may immediately respond thereto or take appropriate countermeasures. In addition in response to the output from the sensors, the work rolls and backup rolls are so automatically controlled as to eliminate the uneven rolling pressure.

7. The fourth embodiment ensures the stable, reliable and dependable operation in case of passing the leading edge of the strip through the continuous hot rolling mill or accelerating the strip.

8. In the fifth embodiment the output from the sensor is not converted into the signal representative of the tension, but is used as the feedback signal in the closed loop control system, and in response to the tension set, the force to be expected to be acting on the sensor when the strip's tension is normal can be calculated so that the tension control in response to the output from the sensor may be much simplified.

9. In the fifth embodiment, the dynamic load is detected in response to the output from the accelerometer so that the apparent load signal from the sensor may be predicted. Therefore the tension control with a higher degree of accuracy can be attained.

What is claimed is:

1. A looper wherein a sensor means capable of detecting the tension is attached to a looper arm which may be rotatable or tiltable vertically and wherein a roller bearing box in which a looper roller is rotatably supported is vertically pivotably to the upper end of said looper arm, and mounted on said looper arm are sensor means which support said roller bearing box and an accelerometer for detecting the acceleration of said looper roller.

2. A looper as set forth in claim 1 including a feedback system for feedbacking the output signal from said sensor means representative of the tension detected to a control unit of a looper driving device and to a speed control system or a rolling pressure control system of at least one stand.

3. A looper as set forth in claim 1, wherein said sensor means and said accelerometer are coupled to an arithmetic unit including arithmetic means capable of removing the acceleration of said looper roller, the weight of said looper roller and the weight of a strip.

4. A looper as set forth in claim 2 wherein said sensor means and said accelerometer are coupled to an arithmetic unit including arithmetic means capable of removing the acceleration of said looper roller, the weight of said looper roller and the weight of a strip.

5. A looper as set forth in claim 1 further comprising first means for carrying out the arithmetic operation of the output from an accelerometer and the output from said sensor means, second arithmetic means for carrying out the arithmetic operation of the output signal from said first arithmetic means and the signal representative of the tension to be set, and third arithmetic means for subtracting the output from said sensor means as a feedback signal from a setting signal.

6. A looper as set forth in claim 5 wherein a pivot arm has its one end attached to a rotary shaft to which is attached the looper arm upon which are mounted said sensor means and said accelerometer, a driving device for rotating said pivot arm is attached to the other end of said pivot arm, and coupled to said driving device is arithmetic means responsive to the outputs from said sensor means and said accelorometer and a setting signal for deriving the control signal to be applied to said driving device, whereby the displacement thereof may be determined.

* * * * *